US006409385B1

(12) United States Patent
Gee

(10) Patent No.: US 6,409,385 B1
(45) Date of Patent: Jun. 25, 2002

(54) APPARATUS AND METHOD FOR PACKAGING ARTICLES THEREIN

(75) Inventor: John F. Gee, Durham, NC (US)

(73) Assignee: Aventis CropScience S.A., Lyons, Cedex (FR)

( * ) Notice: Subject to any disclaimer, the term of this patent is extended or adjusted under 35 U.S.C. 154(b) by 0 days.

(21) Appl. No.: 09/717,989

(22) Filed: Nov. 21, 2000

Related U.S. Application Data

(62) Division of application No. 09/091,905, filed as application No. PCT/US96/20615 on Dec. 24, 1996, now Pat. No. 6,155,714.

(60) Provisional application No. 60/009,423, filed on Dec. 27, 1995.

(51) Int. Cl.[7] ..... B65D 30/22; B65D 33/08

(52) U.S. Cl. ..... 383/10; 383/38; 383/40

(58) Field of Search ..... 206/287.1, 568; 383/38, 40, 10, 7; 150/117

(56) References Cited

U.S. PATENT DOCUMENTS

| | | | | | |
|---|---|---|---|---|---|
| 1,871,549 | A | * | 8/1932 | Miller | 383/38 |
| 2,453,663 | A | * | 11/1948 | Hinson | 206/287.1 |
| 2,813,602 | A | * | 11/1957 | MacArthur, Jr. | 383/7 |
| 3,023,948 | A | * | 3/1962 | Hoeppner | 383/38 |
| 3,108,627 | A | * | 10/1963 | Tatelman | 150/117 |
| 3,125,145 | A | * | 3/1964 | Williams | 150/117 |
| 3,348,759 | A | * | 10/1967 | Johnson | 383/40 |
| 3,370,629 | A | * | 2/1968 | Neuman | 383/38 |
| 3,613,843 | A | * | 10/1971 | Davis | 190/111 |
| 3,685,645 | A | * | 8/1972 | Kawaguchi | 383/38 |
| 3,720,305 | A | * | 3/1973 | Barton | 383/38 |
| 3,802,919 | A | * | 4/1974 | Saffir | 383/38 |
| 3,896,981 | A | * | 7/1975 | Purple | 383/38 |
| 4,125,220 | A | * | 11/1978 | Suominen | 383/9 |
| 4,126,256 | A | * | 11/1978 | McGruder | 383/38 |
| 4,221,321 | A | * | 9/1980 | Langen et al. | 383/10 |
| 4,597,749 | A | * | 7/1986 | O'Brien et al. | 493/226 |
| 4,781,471 | A | * | 11/1988 | Sengewald | 383/7 |
| 4,819,793 | A | | 4/1989 | Willard et al. | |
| 4,821,853 | A | * | 4/1989 | Young | 190/111 |
| 4,854,733 | A | * | 8/1989 | Schwinn | 383/29 |
| 4,872,766 | A | | 10/1989 | Dancy | |
| 4,883,450 | A | * | 11/1989 | Benoit | 493/196 |
| 4,966,260 | A | * | 10/1990 | Young | 190/111 |
| 5,024,536 | A | * | 6/1991 | Hill | 383/38 |
| 5,026,173 | A | * | 6/1991 | Jensen | 383/10 |
| 5,048,976 | A | * | 9/1991 | Jung et al. | 383/10 |
| 5,121,995 | A | * | 6/1992 | Newman et al. | 383/29 |
| 5,282,687 | A | * | 2/1994 | Yee | 383/25 |
| 5,353,900 | A | * | 10/1994 | Stilley | 190/115 |
| 5,400,494 | A | * | 3/1995 | Stilley | 29/454 |
| 5,558,228 | A | | 9/1996 | Jackisch et al. | |
| 5,924,573 | A | * | 7/1999 | Piraneo et al. | 206/554 |
| 6,155,714 | A | * | 12/2000 | Gee | 383/17 |

FOREIGN PATENT DOCUMENTS

| | | |
|---|---|---|
| DE | 3043-762 | 11/1980 |
| DE | 3805-054 A | 2/1988 |
| FR | 1498629 | 9/1966 |
| JP | 5-305951 | 4/1992 |

* cited by examiner

*Primary Examiner*—Stephen P. Garbe
(74) *Attorney, Agent, or Firm*—Jenkins & Wilson, P.A.

(57) ABSTRACT

A flexible, plastic packaging apparatus having a plurality of compartments for containing product therein and a center section interconnecting the plurality of compartments and defining a handle therein whereby the packaging apparatus can contain product separately in each of the compartments and the handle can be used to transport the package.

17 Claims, 3 Drawing Sheets

APPARATUS AND METHOD FOR PACKAGING ARTICLES THEREIN

RELATED APPLICATION

This application is a divisional patent application of U.S. patent application Ser. No. 09/091,905, filed on Nov. 16, 1998, which subsequently issued to Gee as U.S. Pat. No. 6,155,714 on Dec. 5, 2000 which is a 371 of PCT/US96/20615 filed Dec. 24, 1996 and claims the benefit of No. 60/009,423 filed Dec. 27, 1995.

TECHNICAL FIELD

The present invention relates generally to the art of plastic packaging apparatuses, and more particularly, to a flexible, plastic packaging apparatus and method for use in containing and transporting articles held therein.

BACKGROUND ART

A number of packaging apparatuses, such as pouches or bags, constructed of flexible plastic of various compositions can be found in the art. Moreover, the need for flexible plastic bags of various structures which can be utilized to contain and transport articles maintained therein has been and continues to be recognized. Small, conventional sealable plastic bags can be used to carry a variety of articles therein; however, space is often limited and they do not typically provide handle mechanisms for use in transportation. Flexible, plastic bags as presently used in grocery and department stores are sometimes larger and usually include handles or gripping means, but have limitations as to practical use with certain articles, for instance when it is preferred that the articles maintained therein be sealed therein for transportation.

It has been common in the past to package chemicals, in liquid and solid forms, in water-soluble bags or pouches for various applications. Examples of chemicals often packaged in water-soluble pouches include pesticides, herbicides, and fungicides and application of one or more of such chemicals typically entails delivery of a number of the chemical-containing water-soluble pouches to a site for application. Along with the water-soluble pouches, it is also desirable and often necessary to deliver written directions concerning the product or products, and this has been accomplished in the past by the use of pressure-sensitive adhesives usually incurring significant cost.

In delivery of the water-soluble pouches and written directions relating thereto, there is an obvious need to protect such items from moisture. While is has been possible to pack and seal multiple water-soluble pouches in a single compartment plastic package, this approach suffers a disadvantage in that once the package has been opened, all of the pouches must be used or else the package must somehow be re-closed to protect the remaining moisture sensitive, water-soluble pouches, a process which usually requires an expensive re-closure mechanism be added to the package.

The need exists therefore for a more practical, convenient and efficient method for containing and transporting products such as a water-soluble products. Thus, the instant invention meets the long-felt need for an apparatus and method for conveniently containing and transporting water-soluble products, as well as other products.

SUMMARY AND OBJECTS OF THE INVENTION

In accordance with the present invention, applicant provides a packaging apparatus and method for containing and transporting products maintained therein, and more particularly, for containing and transporting water-soluble products. The flexible packaging apparatus for containing and transporting product comprises a plurality of compartments for containing product therein and a center section interconnecting the compartments. Handle means are defined in the center section, and the center section can further define at least one compartment therein.

The method of the invention for containing and transporting product contained in the flexible packaging apparatus comprises the steps of providing a plurality of compartments for containing product with a center section interconnecting the compartments and defining handle means therein, inserting product into the plurality of compartments and optionally inserting an article such as written paperwork into the compartment defined by the center section, sealing the product within the plurality of compartments, and utilizing the handle means defined by the center section to transport the flexible packaging apparatus containing product therein.

It is therefore an object of the present invention to provide a novel packaging apparatus and method for containing and transporting product held therein, particularly water-soluble product.

It is another object of the present invention to provide a packaging apparatus and method which is practical, convenient and efficient for containing and transporting product, particularly water-soluble product.

It is yet another object of the present invention to provide a packaging apparatus and method for containing and transporting product wherein written paperwork, such as directions for use of product contained in the packaging apparatus, can also be contained and transported without using pressure-sensitive adhesives.

It is a further object of the present invention to provide a packaging apparatus and method providing independent and separately sealable compartments for containing product, particularly water-soluble product. It is still a further object of the present invention to provide a packaging apparatus and method for carrying a greater load of product, particularly water-soluble product.

These and other objects are achieved, in whole or in part, by the present invention. Some of the objects of the invention having been stated, other objects will become evident as the description proceeds, when taken in connection with the accompanying drawings described hereinbelow.

DISCLOSURE OF THE INVENTION

Some of the objects of the invention having been stated hereinabove, other objects will become evident as the description proceeds when taken in connection with the accompanying drawings as best described hereinbelow.

DETAILED DESCRIPTION OF THE INVENTION

Figure 1:
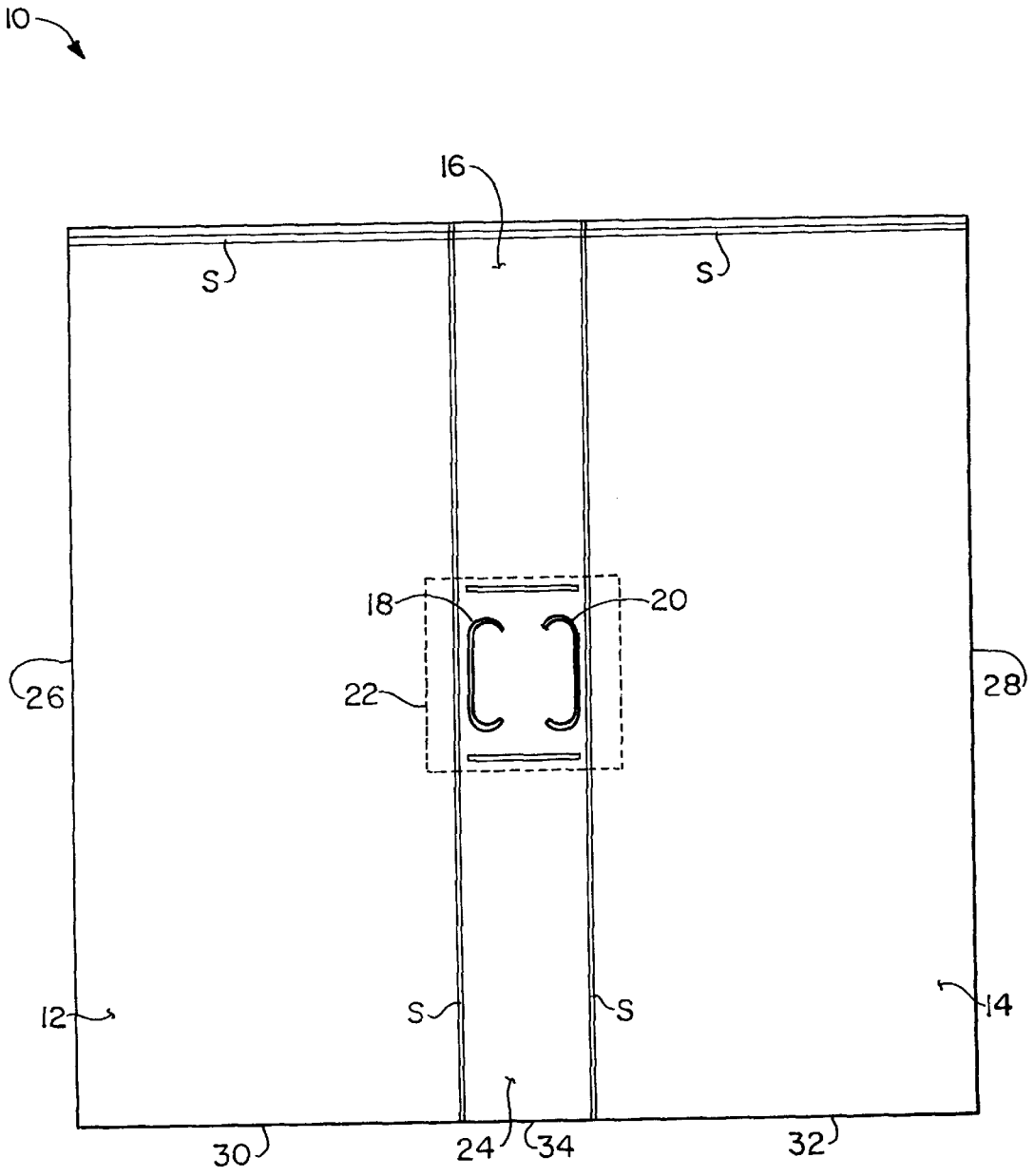
FIG. 1 is a plan view of the apparatus of the present invention.
Figure 2:
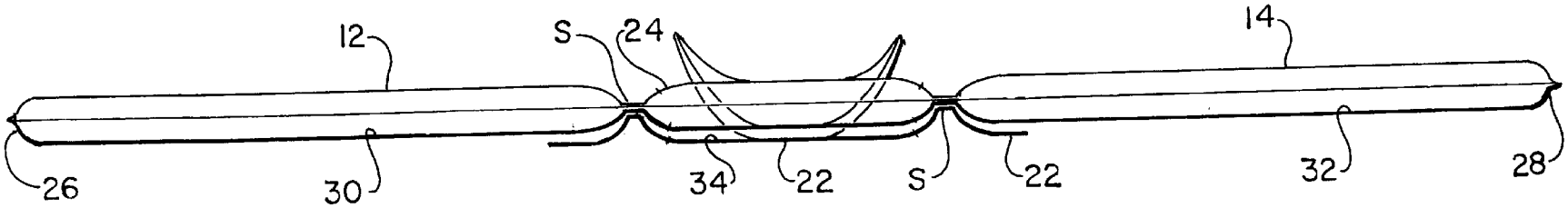
FIG. 2 is an end view of the apparatus of the present invention as shown in FIG. 1.
Figure 3:
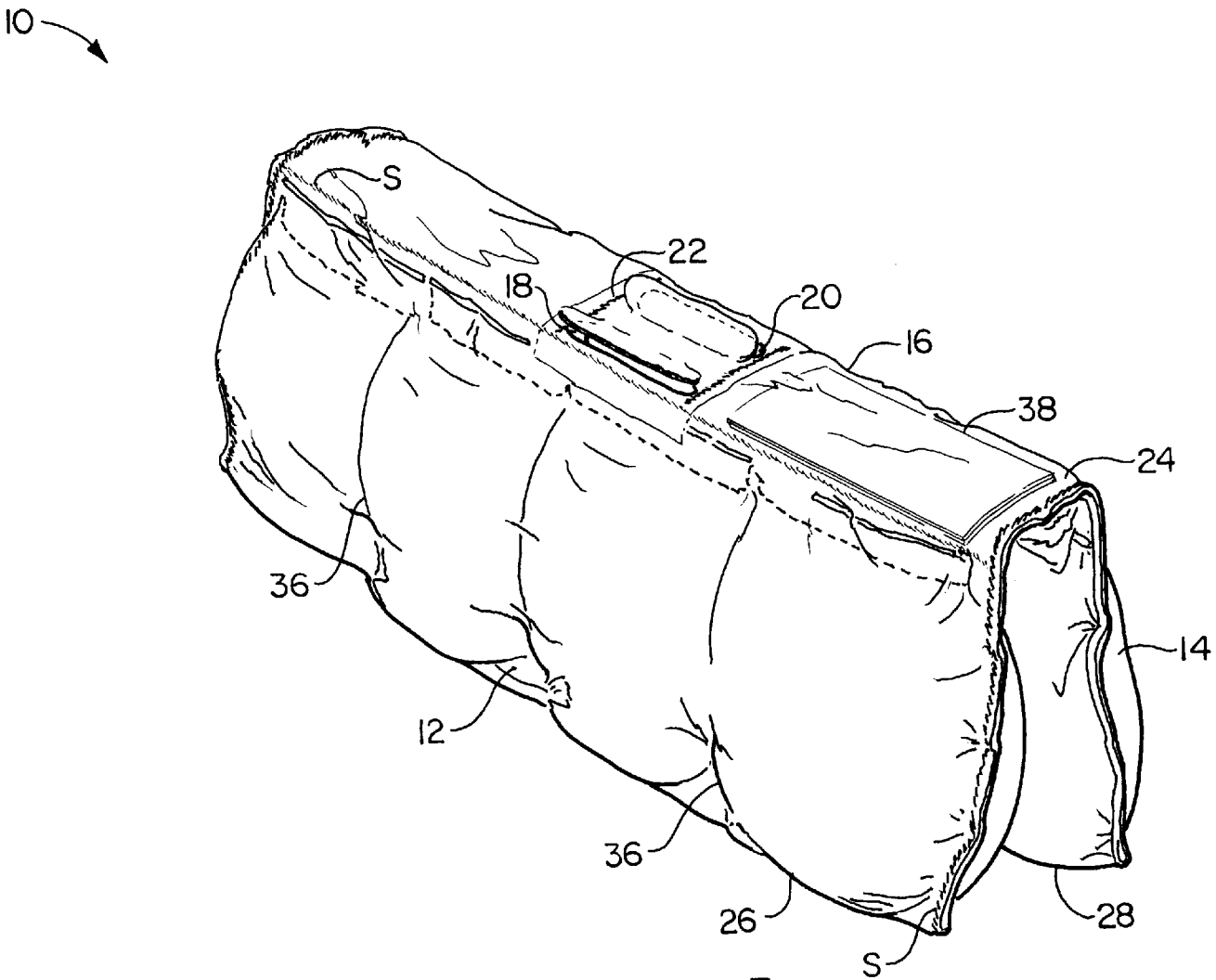
FIG. 3 is a perspective view of the apparatus of the present invention in its intended use and with product contained therein.

Referring now to FIGS. 1–3 of the drawings, FIG. 1 illustrates a top or plan view of flexible packaging apparatus 10 and FIG. 2 illustrates an end view thereof. Although it is contemplated according to this invention that apparatus 10 can be constructed of any flexible, plastic film suitable for use in containing and transporting product as taught herein, particularly water-soluble product, flexible packaging apparatus 10 preferably is constructed of linear low density polyethylene film (LLDPE). It will be understood, however, that other films may also be used, depending upon the compatibility of the material to be packaged and the film as discussed further below. Packaging apparatus 10 is translucent in the preferred embodiment.

Flexible packaging apparatus 10 comprises a plurality of flexible compartments, preferably two compartments shown as compartments 12 and 14, and a flexible center section 16 interconnecting the compartments and defining a handle means therein. While packaging apparatus 10 as taught herein includes only compartments 12 and 14 interconnected by center section 16, it is envisioned in accordance with this invention that more than two (2) compartments can be interconnected by a center section such as center section 16, and further that either or both compartments on opposite sides of center section 16 could be subdivided to form additional compartments.

Center section 16 defines handle means for gripping and carrying packaging apparatus 10. Although it can be appreciated that any conventional structure can be utilized for the handle means, the handle means most suitably comprises a pair of adjacent apertures 18 and 20 which are formed by hot knife die cutting and structured so that tabs defined by apertures 18 and 20 can be displaced by the fingers of one hand so as to enable packaging apparatus 10 to be hand-carried by using apertures 18 and 20. To promote balance and practicality, the handle means defined by center section 16 is preferably positioned centrally on center section 16. Although not necessary, the handle means can include at least one extra layer of plastic film, referred to herein as strengthening patch 22, for reinforcement of the handle means as well as its surrounding area to add tensile strength to the handle means in order to facilitate transportation of packaging apparatus 10. It is also envisioned that film of a higher tensile strength than the remainder of film in the packaging apparatus can be used for center section 16 whereby strengthening patch 22 can be excluded altogether or still used for even further reinforcement.

In the preferred embodiment, center section 16 defines at least one compartment, referred to as center compartment 24, adapted for containing and protecting an article therein. Center compartment 24 can be used to contain and protect from moisture a variety of articles therein, as discussed further with reference to FIG. 3 below.

With reference to FIGS. 1 and 3 particularly, compartments 12 and 14, while being separate and independently sealable compartments, are preferably identical in shape and size. Formation of compartments 12 and 14 can be accomplished by folding plastic film over itself, such as at folds 26 and 28 respectively, and sealing the edges to define the compartments along linear seal lines S. Sealing can be by any conventional method ,such as heat to create a moisture-tight seal in accordance with the preferred embodiment of the invention. Sides 30 and 32 of compartments 12 and 14 respectively have been left unsealed as illustrated in FIG. 1 of the drawings and in accordance with a preferred embodiment of the invention, in order to understand that product can be inserted into compartments 12 and 14 through open sides 30 and 32, and sides 30 and 32 can subsequently be sealed. As illustrated in FIG. 1, the seals S defining compartments 12 and 14 can also serve to define at least one center compartment in center section 16, such as center compartment 24. Center compartment 24 is also shown in FIG. 1 of the drawings with an unsealed side 34 in accordance with a preferred embodiment of this invention and in order to understand that an article such as written paperwork can be inserted into center compartment 24 through open side 34, and side 34 can then be sealed to contain the article therein.

The end view of packaging apparatus 10 shown in FIG. 2 of the drawings illustrates the flattened shape in which packaging apparatus 10 can be made and which can exist when there is no product therein causing it to have a different shape. FIG. 2 better illustrates open sides 30 and 32 of compartments 12 and 14 respectively, and open side 34 of center compartment 24. Strengthening patch 22 can also be easily seen in FIG. 2 as it is shown applied to a bottom side of the packaging apparatus 10 for strengthening the handle means of the packaging apparatus.

Although other sizes are contemplated by the present invention, packaging apparatus 10 is preferably approximately 26 and ⅜ inches in width from fold 26 to fold 28, with center section 16 preferably being approximately four (4) inches in width and compartments 12 and 14 each being approximately eleven (11) inches in width. Packaging apparatus 10 is preferably approximately 26 inches in length, with the length of compartments 12 and 14 and center section 16 being identical.

As discussed above, packaging apparatus 10 is preferably constructed of LLDPE film, which preferably is approximately three (3) mils in thickness and is translucent. It is preferred that strengthening patch 22, applied to provide strength in the form of increased thickness in the area of the handle means, be approximately three times the thickness of the film utilized for packaging apparatus 10, and in the preferred embodiment, strengthening patch 22 is approximately ten (10) mils in thickness and also is constructed of LLDPE film. Although product of various weight can be carried by packaging apparatus 10, it has been found that the preferred embodiment described herein can be used to carry at least ten (10) pounds of product.

While packaging apparatus 10 is preferably constructed of LLDPE film, it is contemplated in accordance with this invention that other film types can be used for the packaging apparatus for physical compatibility with different product contained and transported by use of the packaging apparatus. Factors for consideration in determining the type of film to use for the packaging apparatus include, but are not limited to, the type of product to be contained and transported, and film chemistry, weight, tensile strength, tear strength, impact strength, heat-seal strength, coefficient of friction, haze and gloss, water-vapor transmission, gas permeability, grease and oil barrier, dimensional stability, and temperature ranges.

FIG. 3 of the drawings illustrates flexible packaging apparatus 10 with product, shown as a plurality of pouches 36, contained and sealed within 12 and 14. FIG. 3 additionally illustrates an article 38 contained and sealed within center compartment 24. Article 38 can be written paperwork such as directions for use of material contained within compartments 12, and 14, such as pouches 36. Written paperwork contained in center compartment 24 can be read through the translucent walls of center compartment 24 while contained therein and can also be removed from center compartment 24 and read. Although center compartment 24 is particularly suited for containing written material, the possible contents of center compartment 24 are not limited to written material. It is contemplated in accordance with this invention that center compartment 24 can be used to contain a variety of articles therein, such as protective gloves or even one or more water-soluble pouches containing chemical therein, such as a low-use rate pesticide. As desired, center section 16 can also define an additional compartment therein on the other side of the handle means from center compartment 24.

As can be seen in FIG. 3, flexible packaging apparatus 10 no longer has a substantially flat shape as shown in FIGS. 1 and 2, but rather indicates its flexibility by being bent near or at the juncture of compartments 12 and 14 to center section 16 with packaging apparatus 10 in an upright position with the handle means on a top thereof to facilitate grasping the handle means and utilizing the handle means to carry packaging apparatus 10. The flexibility of packaging apparatus 10 allows compartments 12 and 14 to fall freely downwardly to more of a vertical position when packaging apparatus 10 contains product in compartments 12 and 14 and is picked up from a surface using the handle means. The degree of movement of compartments 12 and 14 among other things, upon the shape, size and weight of the product contained therein. Compartments 12 and 14 can therefore hang from opposing sides of center section 16 when packaging apparatus 10 is carried. In accordance with this invention, center section 16 is of a suitable size to interconnect compartments 12 and 14 in a manner advantageously allowing compartments 12 and 14 to be spaced so that even bulky product can be contained within the compartments and the handle means used to carry packaging apparatus 10 without compartments 12 and 14 being greatly pushed-out or substantially horizontal in position.

While it is contemplated and appreciated in accordance with this invention that packaging apparatus 10 can be used to contain any product, liquid or solid, capable of fitting and being contained within compartments 12 and 14, flexible packaging apparatus 10 advantageously is particularly suited for containing and transporting water-soluble product. As discussed previously, it is common for chemicals such as pesticides, herbicides, and fungicides to be contained within water-soluble pouches and packaging apparatus 10 is particularly suitable for containing a plurality of such water-soluble pouches. Utilizing packaging apparatus 10, a number of water-soluble pouches can be contained and kept dry within compartments 12 and 14, and the packaging apparatus can be transported as desired by utilizing the handle means on center section 16.

Written materials such as directions for use of product contained within compartments 12 and 14 can advantageously accompany the product by being contained and kept dry within center compartment 24 of center section 16. This design is specifically advantageous in that many products in the agricultural market require supplemental written directions to be adhered to the package, and the present design of center compartment 24 in center section 16 allows such written directions to accompany the product without necessitating the use of expensive pressure sensitive adhesives to adhere such written directions to the package.

Once packaging apparatus 10 with product and written directions therein has been transported to a desired location, the written directions contained within center compartment 24 of center section 16 can be obtained by breaking the surrounding plastic film, such as by cutting, and removing the written directions. To obtain product contained within compartments 12 or 14, either compartment can be opened by breaking the plastic film surrounding the product, such as by cutting, and removing the product contained therein. An advantageous feature of packaging apparatus 10 according to this invention is that one of the compartments 12 or 14 can be broken open and the product contained therein then removed while the other compartment can remain sealed and unopened unless and until the need arises for use of the product contained therein.

It is therefore seen in accordance with this invention that a novel packaging apparatus and method for containing and transporting product, particularly water-soluble product, is provided. It is also seen that the packaging apparatus and method according to this invention is practical, convenient and efficient for containing and transporting product, particularly water-soluble product.

It is further seen that the packaging apparatus and method according to this invention includes provision for containing and transporting written paperwork without the need for pressure sensitive adhesives. It is further seen that the packaging apparatus and method according to this invention provides independent and separately sealable compartments for containing product, particularly water-soluble product. It is further seen that the packaging apparatus and method according to this invention can be used to carry a greater load of product, particularly water-soluble product.

It will be understood that various details of the invention may be changed without departing from the scope of the invention. Furthermore, the foregoing description is for the purpose of illustration only, and not for the purpose of limitation the invention being defined by the claims.

What is claimed is:

1. A plastic packaging apparatus for transporting an article comprising:

(a) a plurality of flexible, independent and separately sealable compartments for containing the article therein;

(b) a center section interconnecting said plurality of compartments, said center section constructed of a higher tensile strength plastic than each of said plurality of compartments;

(c) at least one separately sealable center compartment defined within said center section for containing the article therein; and (d) a handle defined within said center section for gripping and carrying said packaging apparatus.

2. The packaging apparatus of claim 1, wherein said packaging apparatus is constructed of a linear low-density polyethylene film.

3. The packaging apparatus of claim 2, wherein said center section further includes a patch having at least one extra layer of a linear low density polyethylene film for reinforcing said handle defined within said center section.

4. The packaging apparatus of claim 1, wherein said center compartment is arranged in a horizontally planar fashion with respect to each of said plurality of compartments hanging perpendicularly downward relative to said center section when said packaging apparatus is in an upright position.

5. The packaging apparatus of claim 1, wherein said center compartment and each of said plurality of compartments have a sealable open side for receiving the article therein.

6. The packaging apparatus of claim 5, wherein said sealable open side of said center compartment and each of said plurality of compartments is separately sealable by a moisture-tight seal for protecting the article contained therein from moisture.

7. A plastic packaging apparatus for containing and transporting an article comprising:

(a) a plurality of flexible, independent and separately sealable compartments being separately sealable by a moisture-tight seal for protectively sealing the article contained therein from moisture;

(b) a center section interconnecting said plurality of compartments, said center section constructed of a higher tensile strength plastic than each of said plurality of compartments;

(c) at least one separately sealable center compartment defined within said center section, said center compartment being separately sealable by a moisture-tight seal for protectively sealing the article contained therein from moisture; and (d) a handle defined within said center section;

whereby said packaging apparatus with said product protectively sealed therein can be carried by said handle with each of said plurality of compartments hanging perpendicularly downward from opposing sides of said center section.

8. The packaging apparatus of claim 7, wherein said packaging apparatus is constructed of a linear low-density polyethylene film.

9. The packaging apparatus of claim 8, wherein said center section further includes a patch having at least one extra layer of a linear low density polyethylene film for reinforcing said handle defined within said center section.

10. The packaging apparatus of claim 7, wherein each of said plurality of compartments hang perpendicularly downward relative to said center section a distance at least double the distance between opposing sides of said center section when said packaging apparatus is in an upright position.

11. A plastic packaging apparatus for transporting an article comprising:

(a) a plurality of flexible, independent and separately sealable compartments for containing the article protectively sealed therein, each of said plurality of compartments having a sealable open side for receiving the article therein, said sealable open side of each of said plurality of compartments being separately sealable by a moisture-tight seal for protecting the article contained therein from moisture;

(b) a center section interconnecting said plurality of compartments, said center section constructed of a higher tensile strength plastic than said plurality of compartments;

(c) at least one separately sealable center compartment defined within said center section for containing the article protectively sealed therein, said center compartment having a sealable open side for receiving the article therein, said sealable open side of said center compartment being separately sealable by a moisture-tight seal for protecting the article contained therein from moisture;

(d) a handle defined within said center section for gripping and carrying said packaging apparatus; and (e) a patch having at least one extra layer of plastic for reinforcing said handle defined within said center section;

wherein said center compartment is arranged in a horizontally planar fashion with respect to each of said plurality of compartments hanging perpendicularly downward relative to said center section a distance at least double the distance between opposing sides of said center section when said packaging apparatus is in an upright position.

12. The packaging apparatus of claim 11, wherein said packaging apparatus is a linear low-density polyethylene film.

13. A packaging apparatus constructed of a linear low-density polyethylene film for containing and transporting an article comprising:

(a) a plurality of flexible, independent and separately sealable compartments being separately sealable by a moisture-tight seal for protectively sealing the article contained therein from moisture;

(b) a center section interconnecting said plurality of compartments, said center section constructed of a higher tensile strength linear low-density polyethylene film than said plurality of compartments;

(c) at least one separately sealable center compartment defined within said center section, said center compartment being separately sealable by a moisture-tight seal for protectively sealing the article contained therein from moisture;

(d) a handle defined within said center section; and (e) a patch having at least one extra layer of linear low-density polyethylene film for reinforcing said handle defined within said center section;

whereby said packaging apparatus with said product protectively sealed therein can be carried by said handle with each of said plurality of compartments hanging perpendicularly downward from opposing sides of said center section a distance at least double the distance between opposing sides of said center section when said packaging apparatus is in an upright position.

14. A method of transporting product comprising the steps of:

(a) providing a plastic packaging apparatus comprising:

(i) a plurality of flexible, independent and separately sealable compartments for containing product therein;

(ii) a center section interconnecting the plurality of compartments, the center section constructed of a higher tensile strength plastic than the plurality of compartments;

(iii) at least one separately sealable center compartment defined within the center section for containing an article therein; and (iv) a handle defined within the center section for gripping and carrying the packaging apparatus;

(b) inserting product within the plurality of compartments;

(c) protectively sealing the product within the plurality of compartments;

(d) inserting the article within the center compartment;

(e) protectively sealing the article within the center compartment;

(f) grasping the handle; and (g) carrying the packaging apparatus with each of the plurality of compartments hanging perpendicularly downward from opposing sides of the center section.

15. A method of transporting product comprising the steps of:

(a) providing a plastic packaging apparatus comprising:

(i) a plurality of flexible, independent and separately sealable compartments for containing product protectively sealed therein;

(ii) a center section interconnecting said plurality of compartments, said center section constructed of a higher tensile strength plastic than said plurality of compartments;

(iii) at least one separately sealable center compartment defined within said center section for containing an article protectively sealed therein;

(iv) a handle defined within said center section for gripping and carrying said packaging apparatus; and (v) a patch having at least one extra layer of plastic for reinforcing said handle defined within said center section;

(b) inserting product within the plurality of compartments;

(c) protectively sealing the product within the plurality of compartments;

(d) inserting the article within the center compartment;

(e) protectively sealing the article within the center compartment;

(f) grasping the handle; and (g) carrying the packaging apparatus with each of the plurality of compartments hanging perpendicularly downward from opposing sides of the center section a distance at least double the distance between opposing sides of the center section when the packaging apparatus is in an upright position.

16. The method of claim 15, wherein the plurality of compartments and the center compartment of the packaging apparatus are separately sealable by a moisture-tight seal for protectively sealing the article contained therein from moisture.

17. A method of transporting product comprising the steps of:

(a) providing a packaging apparatus constructed of a linear low density polyethylene film comprising:

(i) a plurality of flexible, independent and separately sealable compartments being separately sealable by a moisture-tight seal for protectively sealing product contained therein from moisture;

(ii) a center section interconnecting said plurality of compartments, said center section constructed of a higher tensile strength linear low-density polyethylene film than said plurality of compartments;

(iii) at least one separately sealable center compartment defined within said center section, said center compartment being separately sealable by a moisture-tight seal for protectively sealing an article contained therein from moisture;

(iv) a handle defined within said center section; and (v) a patch having at least one extra layer of linear low-density polyethylene film for reinforcing said handle defined within said center section;

(b) inserting product within the plurality of compartments;

(c) protectively sealing the product within the plurality of compartments;

(d) inserting the article within the center compartment;

(e) protectively sealing the article within the center compartment;

(f) grasping the handle; and (g) carrying the packaging apparatus with each of the plurality of compartments hanging perpendicularly downward from opposing sides of the center section a distance at least double the distance between opposing sides of the center section when the packaging apparatus is in an upright position.

* * * * *